US009810101B2

(12) United States Patent
Kral et al.

(10) Patent No.: US 9,810,101 B2
(45) Date of Patent: Nov. 7, 2017

(54) METHOD FOR STARTING A CONTINUOUS STEAM GENERATOR

(75) Inventors: Rudolf Kral, Stulln (DE); Frank Thomas, Erlangen (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 841 days.

(21) Appl. No.: 12/867,057

(22) PCT Filed: Feb. 10, 2009

(86) PCT No.: PCT/EP2009/051496

§ 371 (c)(1),
(2), (4) Date: Aug. 11, 2010

(87) PCT Pub. No.: WO2009/101075

PCT Pub. Date: Aug. 20, 2009

(65) Prior Publication Data

US 2011/0011090 A1 Jan. 20, 2011

(30) Foreign Application Priority Data

Feb. 15, 2008 (EP) ..... 08002850

(51) Int. Cl.
*F01K 13/02* (2006.01)
*F22B 35/14* (2006.01)

(52) U.S. Cl.
CPC ..... *F01K 13/02* (2013.01); *F22B 35/14* (2013.01)

(58) Field of Classification Search
USPC ..... 122/1 R, 488, 489, 1 B, 406.4, 407
See application file for complete search history.

(56) References Cited

U.S. PATENT DOCUMENTS 3,042,007 A * 7/1962 Chien ..... F22D 5/30 122/448.1
3,478,726 A * 11/1969 Kikinis ..... 122/406.1
3,508,526 A * 4/1970 Michel ..... 122/406.4
3,690,303 A 9/1972 Dolezal
3,780,705 A 12/1973 Le Febve de Vivy
4,290,389 A * 9/1981 Palchik ..... 122/406.4
(Continued)

FOREIGN PATENT DOCUMENTS

CN 1168172 A 12/1997
CN 1249807 A 4/2000
(Continued)

OTHER PUBLICATIONS

J. Franke, W. Köhler, and E. Wittchow; "Evaporator concepts for Benson steam generators"; VGB Power Plant Technology 73; 1993; Issue 4, pp. 352-360.

*Primary Examiner* — Nathaniel Herzfeld

(57) ABSTRACT

A method for starting a continuous steam generator is provided. The steam generator includes a combustion chamber provided with a plurality of burners, a water-steam separation device that is mounted downstream of evaporator tubes of the water-steam separation device on a flow-medium side. The amount of water flowing into the water-steam separation device during a starting process is kept to a minimum. The firing power of at least one of the burners is adjusted in accordance with a filling level characteristic value of the water-steam separation device.

15 Claims, 2 Drawing Sheets

(56) References Cited

U.S. PATENT DOCUMENTS

| | | | | | |
|---|---|---|---|---|---|
| 4,353,204 | A | * | 10/1982 | Arakawa | F01K 9/00 122/7 R |
| 4,941,113 | A | * | 7/1990 | Dundics et al. | 702/83 |
| 5,713,311 | A | * | 2/1998 | Fitzgerald | 122/406.5 |
| 5,771,846 | A | * | 6/1998 | Ruchti | F22D 5/32 122/451 R |
| 5,771,849 | A | * | 6/1998 | Hamy | 123/73 R |
| 5,839,396 | A | * | 11/1998 | Franke et al. | 122/406.5 |
| 5,983,639 | A | * | 11/1999 | Kral et al. | 60/646 |
| 6,250,258 | B1 | * | 6/2001 | Liebig | 122/406.5 |
| 2004/0069249 | A1 | * | 4/2004 | Kemp et al. | 122/505 |
| 2005/0045117 | A1 | * | 3/2005 | Rowe et al. | 122/448.1 |
| 2009/0071419 | A1 | * | 3/2009 | Franke et al. | 122/7 R |

FOREIGN PATENT DOCUMENTS

| | | | |
|---|---|---|---|
| CN | 200413671 | A | 8/2004 |
| DE | 19528438 | A1 | 2/1997 |
| EP | 0549522 | A1 | 6/1993 |
| GB | 1207366 | A | 9/1970 |
| JP | 2001033005 | A | 2/2001 |
| JP | 2005188801 | A | 7/2005 |

* cited by examiner

METHOD FOR STARTING A CONTINUOUS STEAM GENERATOR

CROSS REFERENCE TO RELATED APPLICATIONS

This application is the US National Stage of International Application No. PCT/EP2009/051496 filed Feb. 10, 2009, and claims the benefit thereof. The International Application claims the benefits of European Application No. 08002850.9 EP filed Feb. 15, 2008. All of the applications are incorporated by reference herein in their entirety.

FIELD OF INVENTION

The invention relates to a method for starting a continuous steam generator having a combustion chamber comprising a plurality of burners, a water steam separation device that is arranged downstream of the evaporator tubes thereof on the flow medium side.

BACKGROUND OF INVENTION

In a power plant having a steam generator, the energy content of a fuel is used to evaporate flow medium in the steam generator. The steam generator comprises evaporator tubes to evaporate the flow medium, the heating of which results in evaporation of the flow medium conveyed therein. The steam provided by the steam generator can in turn be provided for instance for a connected external process or however to drive a steam turbine. If the steam drives a steam turbine, a generator or a work machine is usually operated by way of the turbine shaft of the steam turbine. In the case of a generator, the current generated by the generator can be provided to supply a grid and/or isolated network.

The steam generator can be embodied here as a continuous steam generator. A continuous steam generator is known from the paper "Verdampferkonzepte fuer BENSON-Dampferzeuger" [Evaporator concepts for Benson steam generators], by J. Franke, W. Köhler and E. Wittchow, published in VGB-Kraftwerkstechnik 73 [VGB power plant technology 73] (1993), issue 4, pages 352 to 360. In the case of a continuous steam generator, the heating of steam generator tubes provided as evaporator tubes results in evaporation of the flow medium into the steam generator tubes in one single passage.

To achieve a particularly high degree of efficiency in the continuous steam generator, superheater tubes are arranged downstream of the evaporator tubes on the flow medium side, said superheater tubes further increasing the enthalpy of the escaping steam. The superheater tubes are configured for the passage of steam and may be damaged upon the ingress of water. A water-steam separation device is therefore usually arranged upstream thereof on the flow medium side, and may include for instance the water steam separator and a water bottle, the so-called water collecting vessel or combinations comprising separators and water bottles. The water-steam separation device does not completely separate evaporated water from steam, initially collects it and then outputs it via a discharge valve. The separated water can either be discarded or fed into the circuit again for renewed evaporation.

In the water-steam separation device, comparatively little or no water at all flows during the permanent operating state of the continuous steam generator, since the water pumped into the evaporator tubes practically completely evaporates. By contrast, a considerably larger water quantity flows into the water-steam separation device during the starting process. When starting a continuous steam generator, an evaporator minimum mass flow is namely usually initially passed through the evaporator tubes for reasons of adequate tube cooling and the burner is ignited with a partial load. Before commencement of evaporation, the entire water flow is fed here to the water-steam separation device. Upon the onset of the evaporation, one portion of the water content between the site of the start of the evaporation and the water-steam separation device is discharged as a result of the sudden increase in volume conditional thereupon. In order, despite this water discharge, to largely prevent an unwanted routing of unevaporated flow medium into the superheater tubes arranged downstream thereof, a correspondingly large dimensioning of all components of the water-steam separation device and the downstream water supply device (for instance flash trap, capacitor, discharge pipe etc.) is usually necessary, this being associated with a high material outlay and expenditure.

A method for starting a continuous steam generator, with which the water discharge can be avoided or kept to a minimum, is known from DE 19528438. With this method, the ratio of firing power and feed water flow is adjusted such that the water pumped into the evaporator tubes also completely evaporates in the partial load region and thus no or almost no water ingress into the water-steam separation device or the superheater tubes takes place. The water discharge is thus minimized here by a feed water supply which is kept correspondingly low.

However, in the case of continuous steam generators, as described in DE 195 28 438, a minimum mass flow density and thus a minimum feed water mass flow is also needed for the reliable cooling of the evaporator tubes even in the case of a minimal firing power. A reduction in the feed water mass flow to prevent a water discharge is correspondingly not possible.

SUMMARY OF INVENTION

An object of the invention is to specify an alternative method for starting a continuous steam generator, in which the water quantity flowing into the water-steam separation device and the water discharge device during the starting process is kept to a minimum, so that a smaller dimensioning of the water-steam separation device and/or water discharge device is possible, whereby an adequate cooling of the evaporator tubes is simultaneously also to be ensured. In the case of a continuous steam generator which is suited to implementing the method, this is to be achieved with simple means.

In respect of the method, this object is achieved in accordance with the invention by the firing power of at least one of the burners being adjusted as a function of a fill level characteristic value for the water-steam separation device.

The invention is based here on the thought that an adequate cooling of the evaporator tubes then remains ensured if the supplied feed water quantity is sufficiently large. Prevention of the water discharge by simply reducing the feed water quantity is therefore not expedient. Nevertheless, a comparatively minimal dimensioning of the water steam separation device and the water discharge device is to be achieved since this would signify a significant saving in terms of material and manufacturing costs when designing the water-steam separation device and the water-discharge device. The water discharge occurring during the starting process should therefore be reduced in a manner other than by influencing the feed water quantity. This can be achieved by distributing the water discharge over a greater period of time. To this end, the incipient evaporation of the water during the starting process should be slowed down, since the water discharge is caused by the sudden onset of evaporation in the evaporator tubes and the volume increase resulting therefrom. This can be achieved by correspondingly influencing the heat supply into the evaporator tubes. This is determined for its part by the firing power and should therefore be controlled by taking the onset of evaporation into account. To determine the point in time of the evaporation setting in, the water discharge caused by the evaporation can be used as an indicator. As the water discharge is indicated in particular by an increase of the water influence into the water-steam separation device, this can take place by measuring a fill level characteristic value of the water-steam separation device.

To determine the incipient water discharge, the evaluation of different characteristic values which are characteristic of the fill level in the water-steam separation device is conceivable. A continuous flow measurement at the inlet of the water-steam separation device could take place for instance, from which indirect conclusions about the fill level can drawn. A particularly reliable implementation can be achieved by a direct measurement of the fill level of the water-steam separation device being provided in a particularly advantageous embodiment. An increase in the fill level in the water-steam separation device indicates an incipient water discharge particularly reliably and can be measured using simple means.

In a further advantageous embodiment of the method, the change in speed of the measured fill level characteristic value can also be taken into account, since a particularly rapid increase provides a further indicator for an incipient water discharge and the extent of the water discharge.

To counteract the water discharge adequately, the heat supply to the evaporation tubes is to be influenced and in particular shut off. During a phase involving increasing the firing power, which is typical during the starting process, this can be achieved by interrupting the increase in the firing power at the point in time when the evaporation sets in. As a result, the evaporation process is slowed down and an overfeed of the water-steam separation device with water is prevented. As the incipient water discharge is indicated in particular by a relatively significant increase in the fill level in the water-steam separation device, this reduction can advantageously take place upon reaching a limit value of the measured fill level characteristic value of the water-steam separation device. This provides for a circuit which is, technically, particularly simple to realize.

In a further advantageous embodiment, when a limit value of the measured fill level characteristic value is reached, the firing power of the burner can not only be kept constant but even be reduced. This brings about an even greater reduction in the heat input into the evaporator tubes and thus an even greater slowing-down of the evaporation process. This enables an even more effective reduction in the water discharge and restriction in the water intake into the water-steam separation device.

In a further advantageous embodiment, account is however taken here of the fact that if possible the stationary start-up firing power should not fall below a minimum level, which, depending on the design of the continuous steam generator, may amount to between 2% and 5% of the maximum firing power (corresponding to a firing power at 100% load) in respect of the stability of the combustion for instance. To this end, the reduction in the firing power when reaching the limit value advantageously amounts to between 1 and 5% of the maximum firing power.

A particularly effective system operation can be achieved by the continuous steam generator being brought into its desired operating state as quickly and immediately as possible after the water discharged after the onset of evaporation is removed. To this end, the firing power is expediently increased again after a holding time. To ensure a complete outflow of the discharged water from the evaporator tubes, a holding time of 1 to 3 minutes is advantageously to be maintained here.

To ensure an increase in the firing power which in terms of time is even better attuned to the end of the water discharge, in a further advantageous embodiment of the invention, this can be increased further for the water-steam separation device when a lower limit value of the fill level characteristic value is reached. This provides for a comparatively more effective and time-saving starting process.

The initial state of a continuous steam generator is very different for warm and cold start. The temperature of the different components has a direct influence on the parameters of the starting process. Different limit values are thus advantageously predefined for the warm and cold start of the continuous steam generator. If the water-steam separation device includes different discharge valves for warm and cold start, during warm start, in which the pressure in the water-steam separation device generally lies above the locking pressure for the cold start discharge valve, the upper limit value may be the uppermost value of the control region for the warm start valve for instance. With the cold start however, in which the pressure in the water-steam separation device lies below the locking pressure for the cold start discharge valve, the upper limit value may be the uppermost value of the fill level control range of the cold start discharge valve. A corresponding optimization of the starting process is thus enabled.

In respect of the continuous steam generator having a combustion chamber comprising a number of burners, a water steam separation device being arranged downstream of the evaporator tubes thereof on the flow medium side, the object is achieved by a control unit provided to adjust the firing power being connected to a sensor for measuring a fill level characteristic value of the water-steam separation device on the data input side.

The sensor advantageously directly measures the fill level of the water-steam separation device. The fill level of the water-steam separation device offers a variable which is particularly simple to process, for controlling the firing power.

The advantages achieved with the invention consist in particular in early recognition of the incipient water discharge being possible during the starting phase, i.e. in the first 20 minutes after ignition of the burner and below 15% of the maximum firing power, by measuring or observing the water quantity in the water-steam separation device, and this can be lowered by means of requirements-based controlling of the firing power, in particular a reduction in the firing power. The water quantity introduced into the water-steam separation device is thus reduced and the water-steam separation device and water discharge device can be of smaller overall dimensions so that considerable material and manufacturing costs can be saved.

BRIEF DESCRIPTION OF THE DRAWINGS

An exemplary embodiment of the invention is described in more detail with the aid of a drawing, in which.

DETAILED DESCRIPTION OF INVENTION

Figure 1:
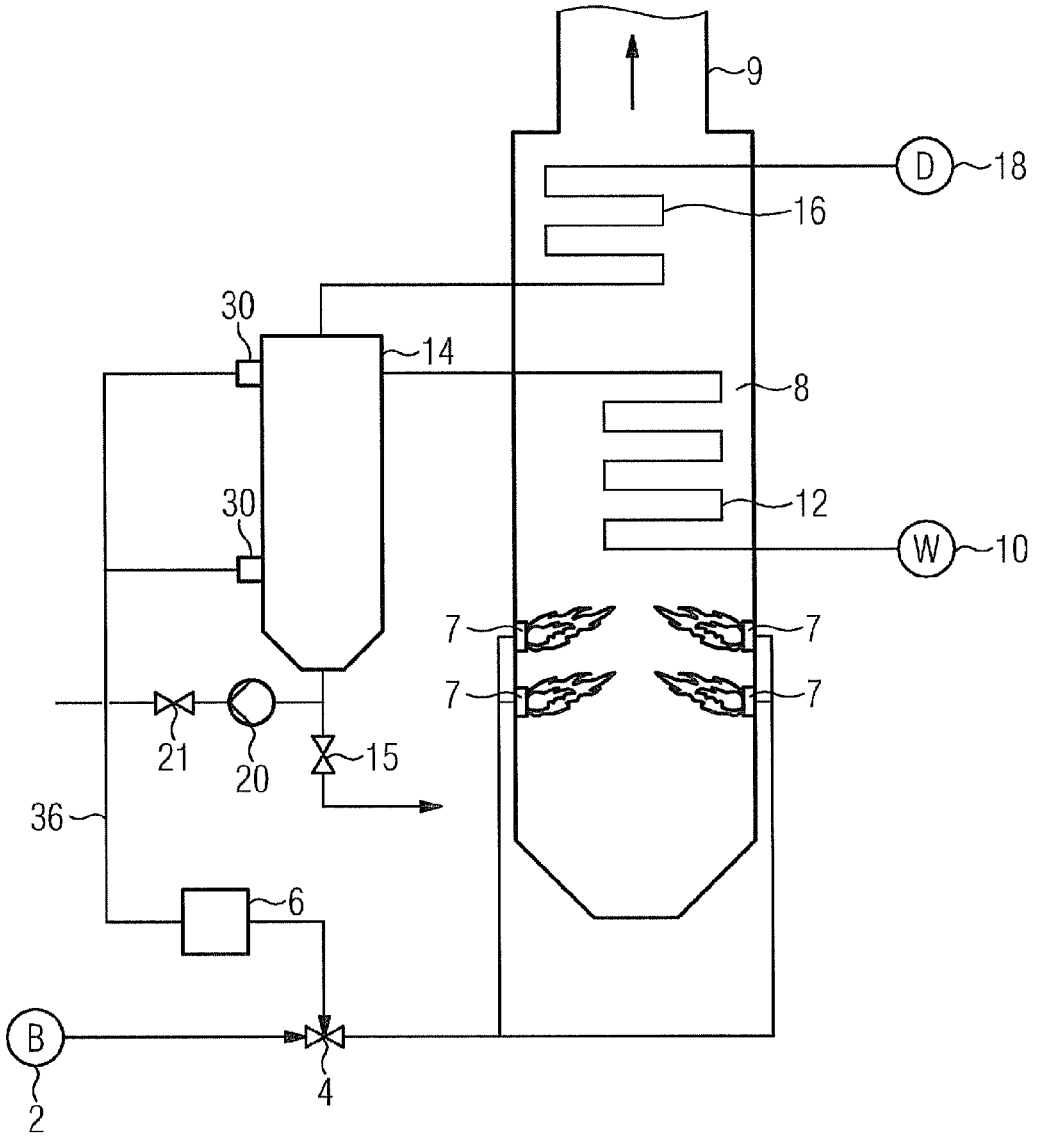
FIG. 1 shows a schematic continuous steam generator with a water-steam separation device, here for instance with a circulating pump, and a control device for the firing power

The continuous steam generator 1 according to FIG. 1 is embodied in a vertical structure. The quantity of fuel B introduced by the fuel inlet 2 is influenced by a control valve 4, which is adjusted by a control device 6. The control device 6 thus directly controls the firing power of the burner 7. The hot gas generated by the combustion process flows through the combustion chamber 8 and enters a gas pass 9. Further components (not shown) like for instance an economizer can be arranged downstream of the gas pass 9.

Water W initially enters the evaporator tubes 12 on the flow medium side through a water inlet 10, said evaporator tubes opening into the water steam separation device 14 on the outlet side. Non-evaporated water is collected in the water-steam separation device 14 and is, as it is pressurized, either completely removed from the system by a discharge valve 15 or in the case of an evaporator system with a recirculation circuit a proportional division of the whole discharge mass flow from the water-steam separation device between a circulating pump 20 (with downstream circulating control valve 21) and a discharge valve 15 takes place proportionately. The discharged water can thus either be rejected or fed back into the system by way of the water inlet 10. Instead of the discharge valve 15 shown here, different discharge valves can also be provided for the warm and cold start, which are adjusted in terms of their design to the different initial states of the continuous steam generator 1 during the hot and cold start.

The generated steam D escapes from the water-steam separation device 14 into the superheater tubes 16, where it is superheated again and subsequently supplied for further use by means of the steam outlet 18. The steam is typically supplied to generate power in a steam turbine (not shown here).

The control device 6 for the firing power is configured such that an excessive water discharge as a result of the sudden onset of evaporation during the starting process is prevented by a prompt influence, in particular temporary reduction in the firing power. To this end, the water-steam separation device 14 is equipped with different sensors for measuring the fill level characteristic values. This includes one or more fill level sensors 30, which are connected to the control device 6 by way of a data line 36. The fill level characteristic values of the water-steam separation device are thus read out by the control device 6 and thus enable a prompt increase in the fill level in the water-steam separation device 14. This fill level change is a result of the water discharge from the evaporator tubes 12, which is triggered for its part by the incipient evaporation. The control device 6 thus receives reliable data relating to the incipient evaporation in the evaporator tubes 12 by way of the fill level sensors 30 and is configured for a prompt intervention in the burner control in order to restrict a further evaporation and thus the ingress of water into the water-steam separation device.

Figure 2:
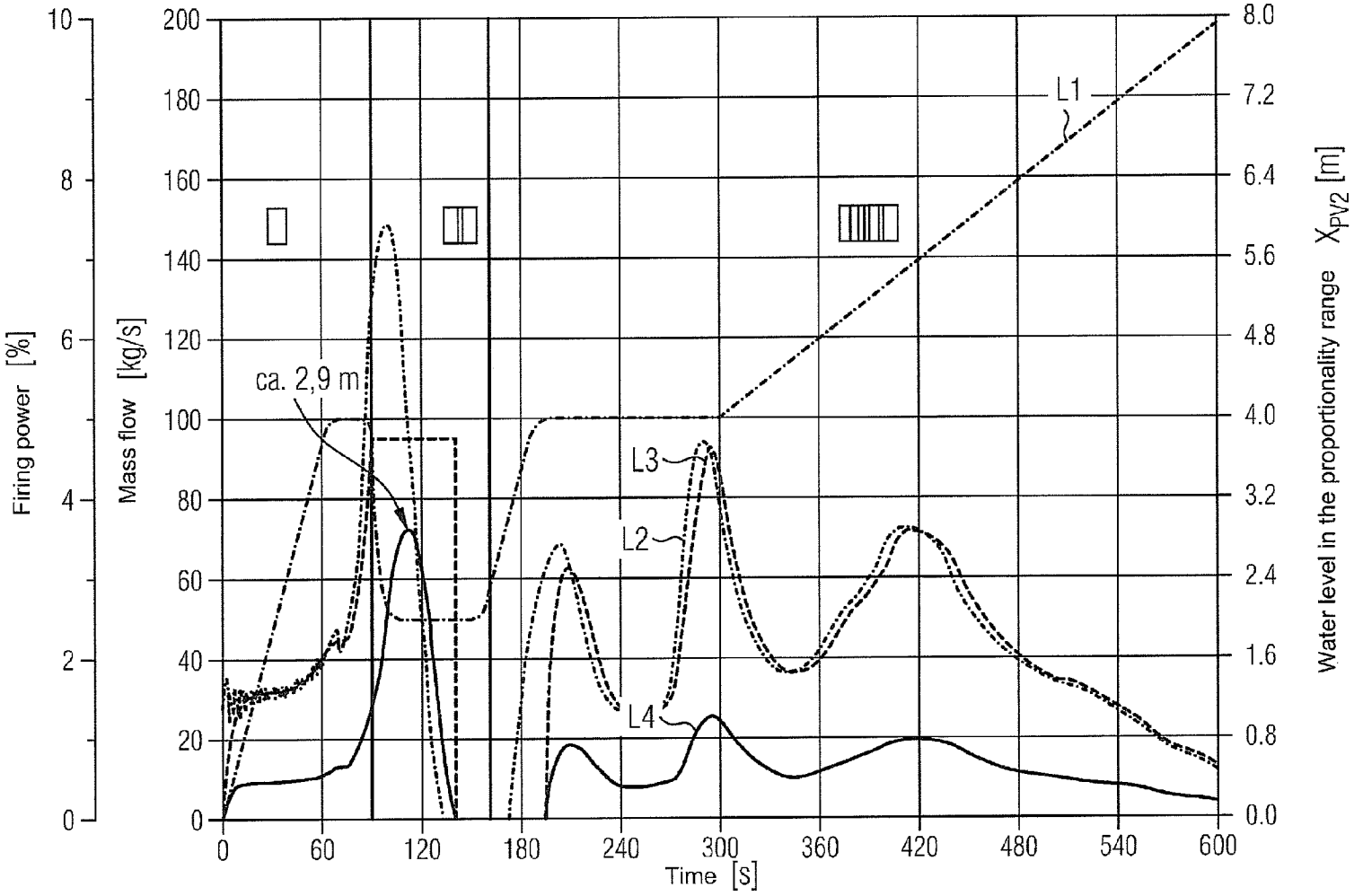
FIG. 2 shows a graphic representation of the starting process of a continuous steam generator.

The temporal course of a starting process of the continuous steam generator is shown with the aid of the relevant parameters or data in the diagram according to FIG. 2. The process data of a typical starting process which is determined with a simulation program is plotted against the time in FIG. 2. Here line L1 shows the firing power of the burner 7 in terms of percentage of the maximum firing power, controlled by the control device 6. Line L2 shows the intake mass flow in the water-steam separation device 14, line L3 shows the discharge mass flow of the water quantity through the discharge valve 15. Line L4 shows the data of the fill level sensor 30 and thus the fill level of the water-steam separation device 14.

In region I, the burners 7 are initially brought up to a firing power of 5% of the maximum firing power. After approximately 75 seconds, the evaporation starts in the evaporator tubes 12, which initiates a water discharge which can be identified by the sudden increase in the intake mass flow into the water-steam separation device. After approximately 90 seconds, the discharge mass flow achieves the maximum throughput capacity of the discharge valve 15 and the water level of the water-steam separation device 14 rises.

When the limit value of 1.2 m for the fill level in the water steam separation device 14 is reached, a reduction in the firing power by 2.5% of the maximum firing power is triggered in region II. Other measured variables could also be used here as indicators, for instance the first derivative, i.e. the change in speed of the fill level could be used as an indicator.

By reducing the firing power, the heat input into the evaporator tubes is lowered and the evaporation process is thus slowed down. By slowing down the volume increase determined by the evaporation process, the water discharge is reduced and the further increase in the fill level in the water steam separation device 14 can be limited to approximately 2.9 m. This enables a corresponding cost-effective smaller dimensioning of all components of the water-steam separation device and the water discharge device.

After a holding time of approximately 60 seconds, the firing power in region III is increased by the previously reduced 2.5% of the maximum firing power. Furthermore, the firing power is further increased and the permanent operating state of the continuous steam generator is thus established.

The method thus effectively restricts the maximum fill level of the water-steam separation device 14 by prompt intervention in the firing power of the burner 7 and thus reliably prevents water ingress into the superheater tubes 16.

The invention claimed is:

1. A method of starting a continuous steam generator, comprising:

providing a combustion chamber comprising a plurality of burners, a water-steam separation device being arranged downstream of a plurality of evaporator tubes of the combustion chamber on a flow medium side, and a plurality of superheater tubes arranged downstream of both the plurality of evaporator tubes and the water-steam separation device; measuring by a sensor a value of a fill level of water-steam separation device;

adjusting a firing power of at least one of the burners by a control unit as a function of a value of the fill level of water for the water-steam separation device to minimize the water quantity flowing into the water-steam separation device during a starting process, wherein the firing power is adjusted as a function of a change in speed of the value of the fill level such that the firing power is adjusted when the value of the fill level is increasing, and wherein the water is a result of water discharge due to incipient evaporation.

2. The method as claimed in claim 1, wherein the firing power is not increased when an upper limit value of the value of the fill level is reached.

3. The method as claimed in claim 1, wherein the firing power is reduced when an upper limit value of the value of the fill level is reached.

4. The method as claimed in claim 3, wherein the firing power is reduced by 1% to 5% of a maximum firing power.

5. The method as claimed in claim 2, wherein the firing power is subsequently increased after a holding time for enabling a complete outflow of discharged water from the evaporator tubes expires.

6. The method as claimed in claim 3, wherein the firing power is subsequently increased after a holding time for enabling a complete outflow of discharged water from the evaporator tubes expires.

7. The method as claimed in claim 4, wherein the firing power is subsequently increased after a holding time for enabling a complete outflow of discharged water from the evaporator tubes expires.

8. The method as claimed in claim 5, wherein the holding time is 1 minute to 3 minutes and begins after the upper limit value is reached.

9. The method as claimed in claim 6, wherein the holding time is 1 minute to 3 minutes and begins after the upper limit value is reached.

10. The method as claimed in claim 7, wherein the holding time is 1 minute to 3 minutes and begins after the upper limit value is reached.

11. The method as claimed in claim 2, wherein the firing power is increased again when a lower limit value of the value of the fill level is achieved.

12. The method as claimed in claim 3, wherein the firing power is increased again when a lower limit value of the value of the fill level is achieved.

13. The method as claimed in claim 2, wherein different limit values are predetermined for warm and cold start processes of the continuous steam generator.

14. The method as claimed in claim 3, wherein different limit values are predetermined for warm and cold start processes of the continuous steam generator.

15. A continuous steam generator, comprising:

a combustion chamber with a plurality of burners and evaporator tubes;

a water-steam separation device being arranged downstream of the evaporator tubes on a flow medium side and upstream of a plurality of superheater tubes;

a sensor for measuring a value of a fill level of the water-steam separation device wherein water in the water-steam separation device is a result of water discharge due to incipient evaporation; and a control unit for adjusting a firing power, wherein the control unit is connected on a data input side to the sensor for measuring a value of the fill level of the water-steam separation device wherein the control unit adjusts the firing power as a function of the value to minimize the water quantity flowing into the water-steam separation device during a starting process wherein the water quantity provides sufficient cooling of the evaporator tubes, and wherein the control unit adjusts the firing power as a function of a change in speed of a value of the fill level such that the firing power is adjusted when the value of the fill level is increasing.

* * * * *